US005992723A

United States Patent [19]

Lee

[11] Patent Number: 5,992,723

[45] Date of Patent: Nov. 30, 1999

[54] SHAFT-OPERATED NAILING TOOL

[76] Inventor: Chung-Heng Lee, No. 76, Pao-Kao Rd., Hsintien City, Taipei Hsien, Taiwan

[21] Appl. No.: 09/128,419

[22] Filed: Aug. 4, 1998

[51] Int. Cl.[6] ..... B25C 1/14

[52] U.S. Cl. ..... 227/9; 227/10

[58] Field of Search ..... 227/9, 10, 11

[56] References Cited

U.S. PATENT DOCUMENTS

| | | | |
|---|---|---|---|
| 4,655,380 | 4/1987 | Haytayan | 227/9 |
| 5,170,922 | 12/1992 | Ehmig et al. | 227/10 |
| 5,363,736 | 11/1994 | Huang | 227/10 |
| 5,518,161 | 5/1996 | Thompson | 227/10 |
| 5,653,370 | 8/1997 | Bereiter et al. | 227/10 |
| 5,715,983 | 2/1998 | Lee | 227/9 |

*Primary Examiner*—Scott A. Smith
*Attorney, Agent, or Firm*—Parkhurst & Wendel, L.L.P.

[57] ABSTRACT

A shaft-operated nailing tool has a barrel body with an annular stop secured therein, and a tube assemble movable forward from and backward to the annular stop within the barrel body. The nailing tool also includes: a position member having a sleeve extending backwardly therefrom; a firing-pin movably received in the sleeve of the position member; a cocking member mounted around the sleeve of the position member, the cocking member having a lever pivotally connected thereto; a stock movably disposed in the rear portion of the barrel body behind the firing-pin and the sleeve of the position member; an inner spring compressed between the ring-pin and the stock; an outer spring compressed between the cocking member and the stock; a connector for interconnecting the stock and the shaft; a linkage extending through the annular stop and the position member from the tube assemble to the cocking member; and the lever of the cocking member having a front end in relation with the firing-pin and a rear end in relation with the stock so that the front end of the lever may trigger the firing-pin when the stock is pushed forward sufficiently with respective to the barrel body.

8 Claims, 6 Drawing Sheets

SHAFT-OPERATED NAILING TOOL

FIELD OF THF INVENTION

The present invention relates to a shaft-operated nailing tool and, more particularly, to a nailing tool of such a type which assures the firing-pin to be positioned in place within a barrel body before the striking of the firing pin.

BACKGROUND OF THE INVENTION

Conventional nailing tools are typically designed to be operated by actuating a trigger to control the striking of a firing-pin onto a powder charge that will propel a nail received within the barrel into a work piece. In most cases, however, the tool is used for interior decoration, where it may be necessary for a user to lift the nailing tool high enough to press it against the ceiling or an object at a distance from him/her. For this reason, shaft-operated nailing tools that have an elongated extension shaft for handling the tool by a user were developed. As illustrated in FIG. 7, one of such a shaft-operated tool includes a barrel body (80) with an annular stop (801) fastened therein. Preceding the annular stop (801) within the barrel body (80) there is a nail sheath (802), followed by a tube assemble (81) and a first spring (82) which is compressed between the tube assemble (81) and the annular stop (801).

Following the annular stop (801) within the barrel body (80) there are a positioning member (83), a sleeve (84) secured to a rear portion of the positioning member (83), a firing-pin (85) and an inner tube (86) disposed in the sleeve (84), and a connector (87) threadedly connected to the inner tube (86) for interconnecting the nailing tool and the extension shaft (870). In addition, a second spring (860) is provided in the inner tube (86) to push the firing-pin (85) forward and a third spring (861) is provided between the inner tube (86) and the positioning member (83).

In operation, when the nailing tool is pressed at the tube sheath (802) against the ceiling of the room, through the extension shaft (870) by the user, the annular stop (801) is displaced upward to the end of the tube assembly (81), against the first spring (82) between the annular stop (801) and tube assembly (81). Then, the subsequent press from the extension shaft (870) will move the connector (87) upward while compressing the second and third springs (860), (861), and eventually the firing-pin (85) is driven to strike a bullet by means of the resilience force stored in the second spring (860), once the inner tube (86) depresses a trigger member (850) projected form the periphery of the firing-pin (85) and rests against the positioning member (83).

It may be appreciated that the first, second and third springs (82), (860) and (861) are in closed relationship with each other, for example, the spring (82) must be compressed to such an extent that the tube assembly (83) is positioned in place within the barrel body (80) to contact with the annular stop (801), before the second and third springs (860) and (861) are compressed to such an extent that the inner tube (86) depress the trigger member (850).

As a result, it is necessary to calculate the elastic coefficients of the springs (82), (860) and (861) precisely. A miscalculation of the elastic coefficients of any of the springs (82), (860) and (861) will lead to a malfunction of the nailing tool, or an explosion may even occur inside the barrel body (80) itself.

From the foregoing, it is clear that the nailing tool mentioned above is possible to strike before the tube assembly (81) is positioned in place with the barrel body (80), thus result in a malfunction of the tool or even an explosion in the barrel body (80), which could be fatally harmful to the user.

SUMMARY OF THE INVENTION

The object of the present invention is to provide a shaft-operated nailing tool which may assure the firing-pin to be positioned in place within the barrel body before the striking of the firing pin.

DETAILED DESCRIPTION OF PREFERRED EMBODIMENT

Figure 1:
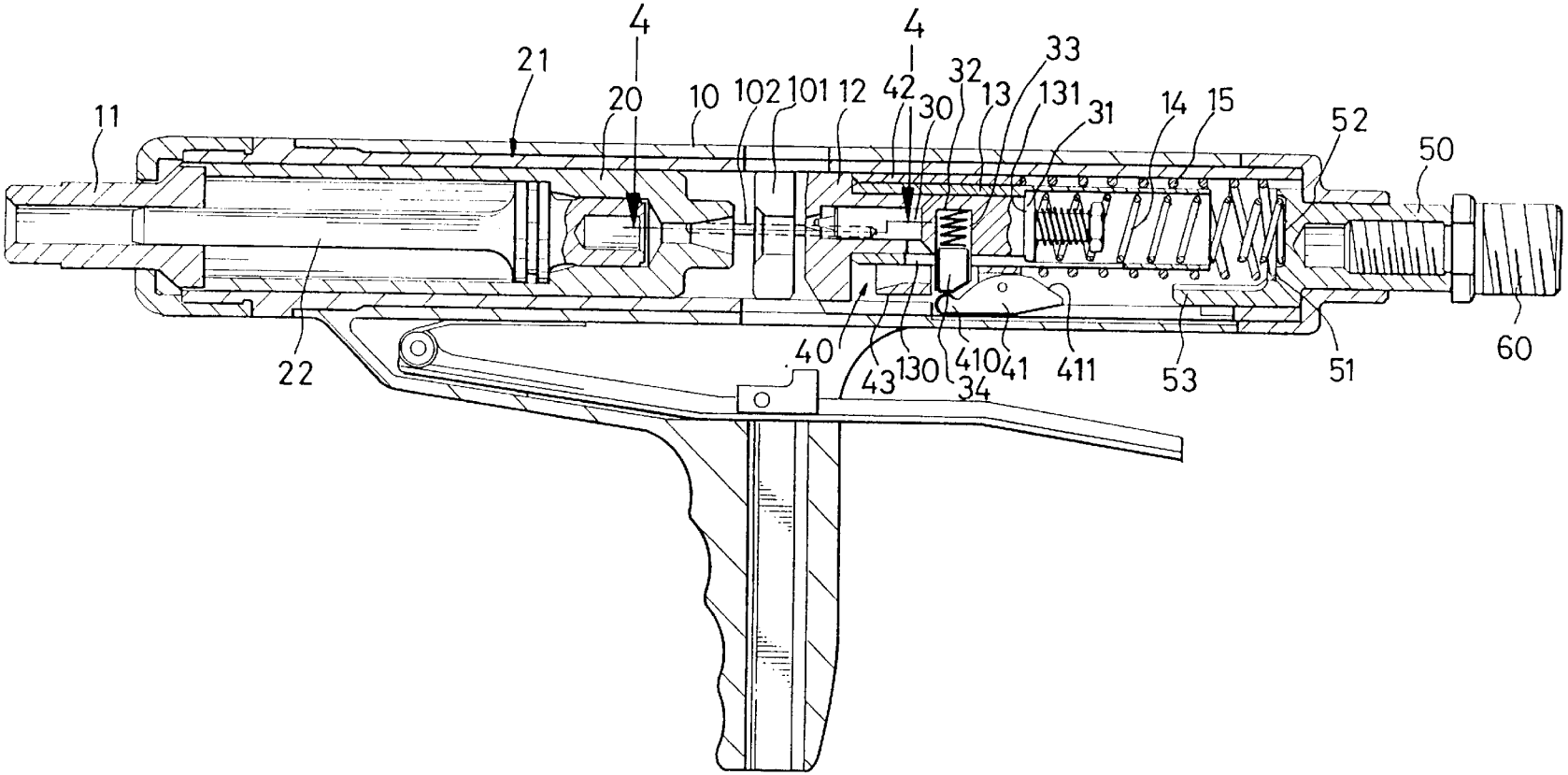
FIG. 1 is a partial cross-sectional view of a stack-operated nailing tool in accordance with the present invention.

Referring to FIG. 1, a preferred embodiment of a nailing tool in accordance with the present invention has a barrel body (10) with an annular stop (101) positioned in the proximity of the midpoint of the barrel body (10).

In front of the annular stop (101) is a nail sheath (11), followed by a tube assembly (20) that is movable forward from and backward to the annular stop (101) within an outer tube (21) intervening between the barrel body (10) and the tube assembly (20), with a piston (22) received in the tube assembly (20). The tube assembly (20) is engaged with the nail sheath (11) in such a way that it can be displaced backward when the nail sheath (11) is retracted into the barrel body (10) as the front end thereof is pressed against a work piece.

The nailing tool is characterized by having behind the annular stop (101): a position member (12) having a sleeve (13) extending backward therefrom, a firing pin (30) movably received in the sleeve (13), a cocking member (40) mounted around the sleeve (13) and having a lever (41) pivotally connected thereto, a stock (50) movably disposed in the rear portion of the barrel body (10) behind the fring-pin (30) and the sleeve (13), an inner spring (14) between the firing-pin (13) and the stock (50), an outer spring (15) compressibly received between the cocking member (40) and the stock (50), and a connector (60) to interconnect the stock (50) and a extended shaft (not shown).

In detail, the sleeve (13) of the position member (12) has a groove (130) defined in place at the bottom thereof, and has a front section of a first inner diameter and a rear section of a second inner diameter larger than the first inner diameter, with a step (131) at an intersection between the first and second inner diameters.

Figure 4:
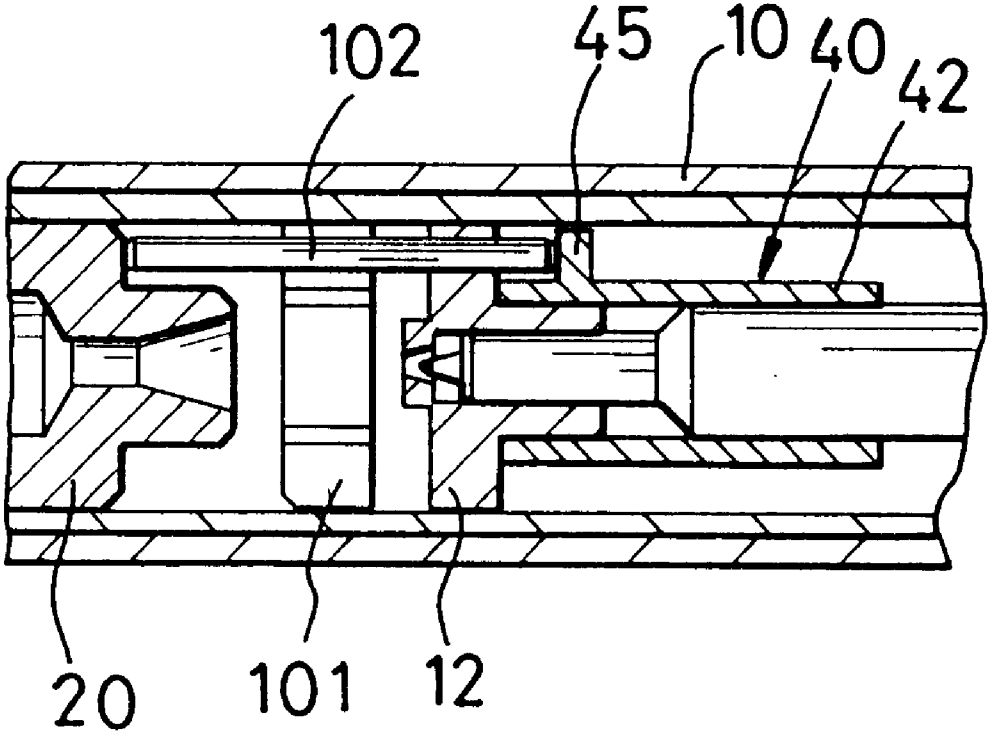
FIG. 4 is a partially cross-sectional top view of the shaft-operated nailing tool of FIG. 1.

The position member (12) is secured in the barrel body (10) and has defined therein a through-hole ( not shown ) in correspondence with a linkage (102), which extends through the annular stop (101) and the position member (12) from the tube assemble (20) to the cocking member (40), shown in FIG. 4.

Figure 3:
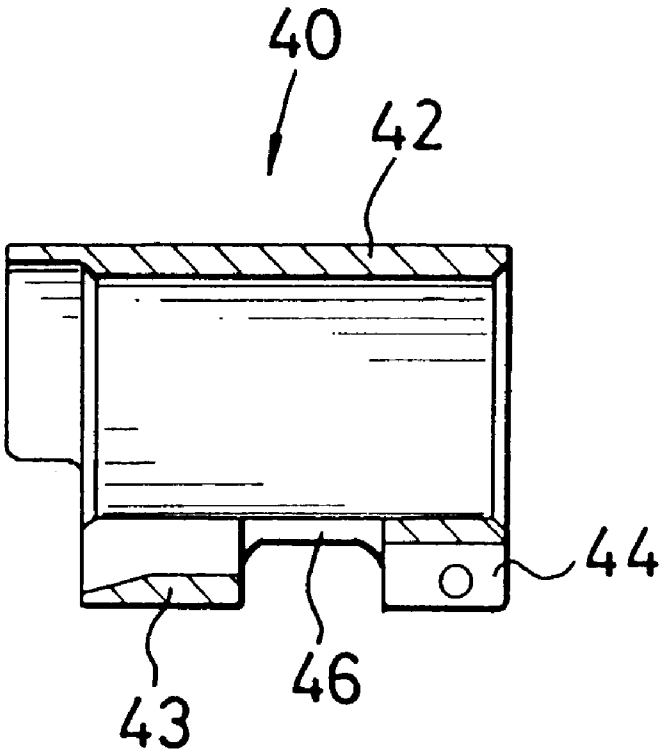
FIG. 3 is a cross-sectional side view of the cocking member shown in FIG. 2.
Figure 2:
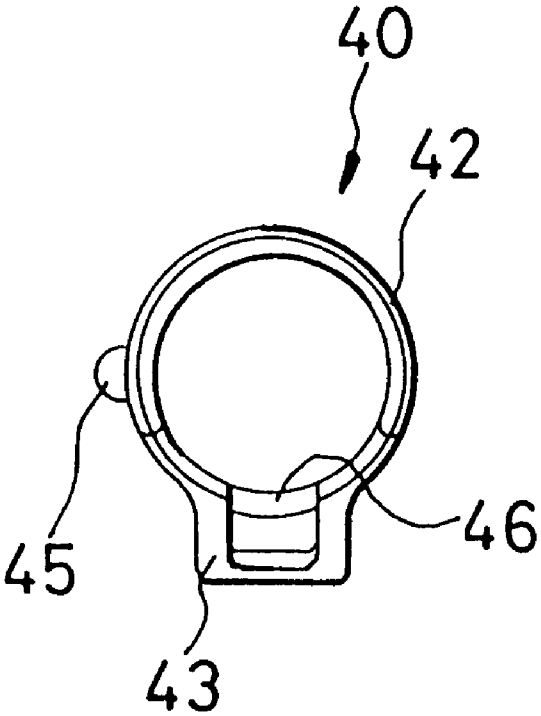
FIG. 2 is a cross-sectional front view of a cocking member involved in the stack-operated nailing tool of FIG. 1.

Referring to FIGS. 2 and 3, the cocking member (40) includes a cylindrical body (42) to allow the mounting of the cocking member (40) around the sleeve (13) of the position member (12). Formed beneath the front end of the cylindrical body (42) is a U-shaped stop (43), and a tap (44) to pivotally connect the lever (41) formed beneath the rear end thereof. As shown in FIG. 4, a protrusion (45) is formed in the cylindrical body (42) to abut an end of the linkage ( 102). In addition, the cylindrical body (42) has an opening (46) defined axially between the U-shaped stop (43) and the tap (44). The opening (46) is in communication with the groove (130) of the position member (12) and in correspondence to the front end of the lever (41) of the position member (12).

Referring back to FIG. 1, the lever (41) is provided at the front end thereof with a cam (410) corresponding to the opening (46) of the positioning member (12), and at the rear end thereof with a slanting edge (411) corresponding to the stock (50).

As mentioned above, the firing-pin (30) is movably received in the sleeve (13) of the position member (12). The firing-pin (30) has a front end aligned with a central hole of the position member (12), and at the back end thereof a circular back plate (31) sized to be stopped at the step (131) of the sleeve (13) when the firing-pin (30) is moved forward beyond a predetermined position. The circular back plate (31) is pressed by an end of the inner spring 14.

Furthermore, a radial blind bore (32) is defined in the firing-pin (30) to movably receive a trigger member (34) and a compression spring (33) that is disposed between the trigger member (34) and the bottom end of the blind bore (32). The trigger member (34) normally extends through both the groove (130) of the sleeve (13) and the opening (46) of the cocking member (40) under the action of the compression spring (33), and rests against or is stopped by the back surface of the U-shaped stop (43) of the cocking member (40), in preparation for being cocked.

The stock (50) has a threaded tubular portion formed at the rear end thereof to threadingly engage with the connector (60). The stock (50) has formed at the front end thereof with an outer recess (51) in contact with the outer spring (15) and an inner recess (52) in contact with the inner spring (14). Moreover, the stock (50) is provided at the front end thereof an extension (53) which may contact with the slanting edge (411) of the lever (41).

With such a design, the tube assembly 20 is positioned in place prior to the striking of the firing-pin (30), as is to be described in detail hereinafter.

Figure 5:
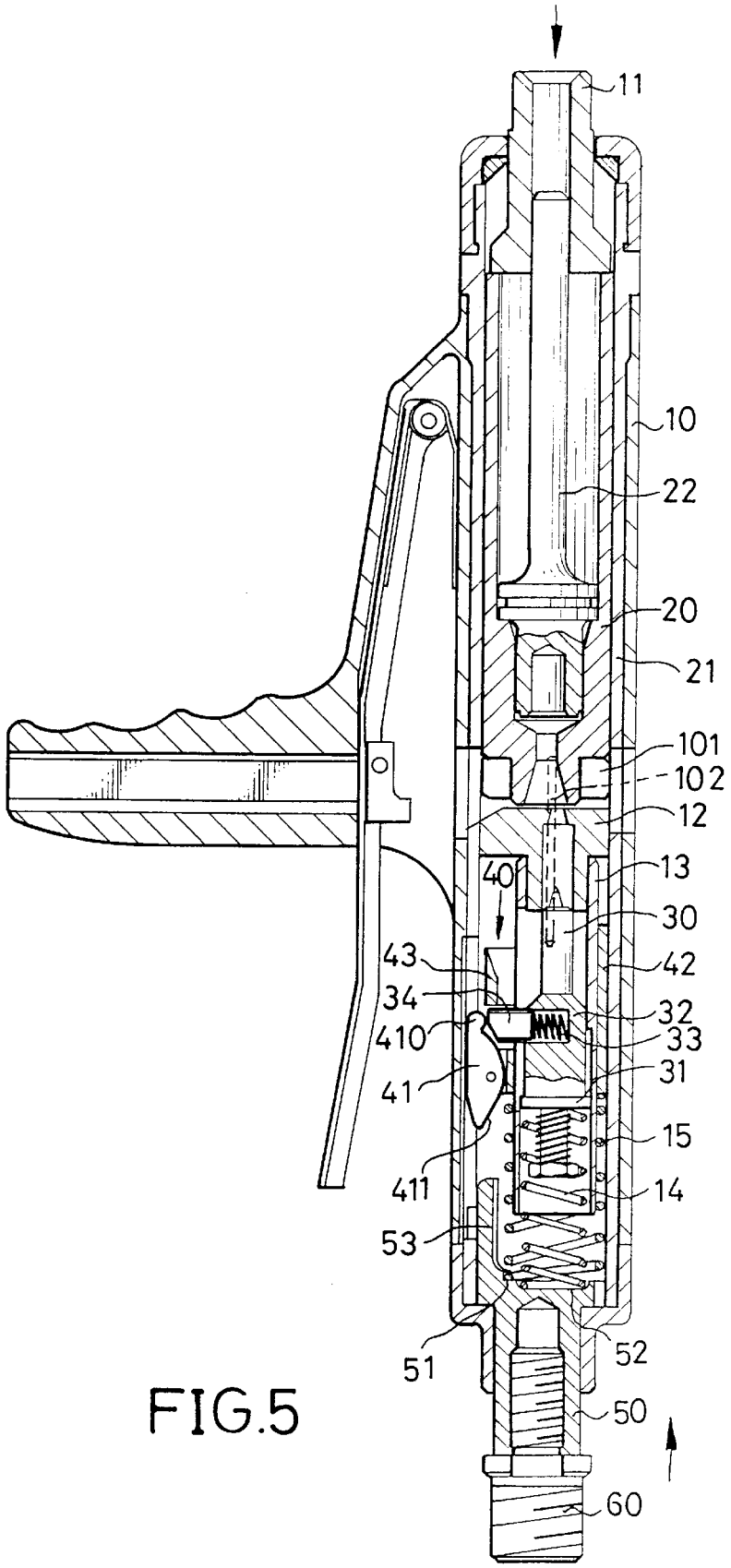
FIG. 5 is a partially cross-sectional view showing a tube assembly of the shaft-operated nailing tool being positioned in place within a barrel body without a trigger member being depressed.

Referring to FIG. 5, when the nailing tool is applied to the work piece, the nail sheath (11) is pressed against the work piece and retracted into the barrel body (10). This results in the backward movement of the tube assemble (20) which pushes the cocking member (40) backwardly via the linkage (102) extending therebetween, thus driving, with the U-shaped stop (43) of the cocking member (40), the trigger member (34) and hence the firing-pin towards the stock (50) and compressing the inner and outer springs (14) and (15).

Figure 6:
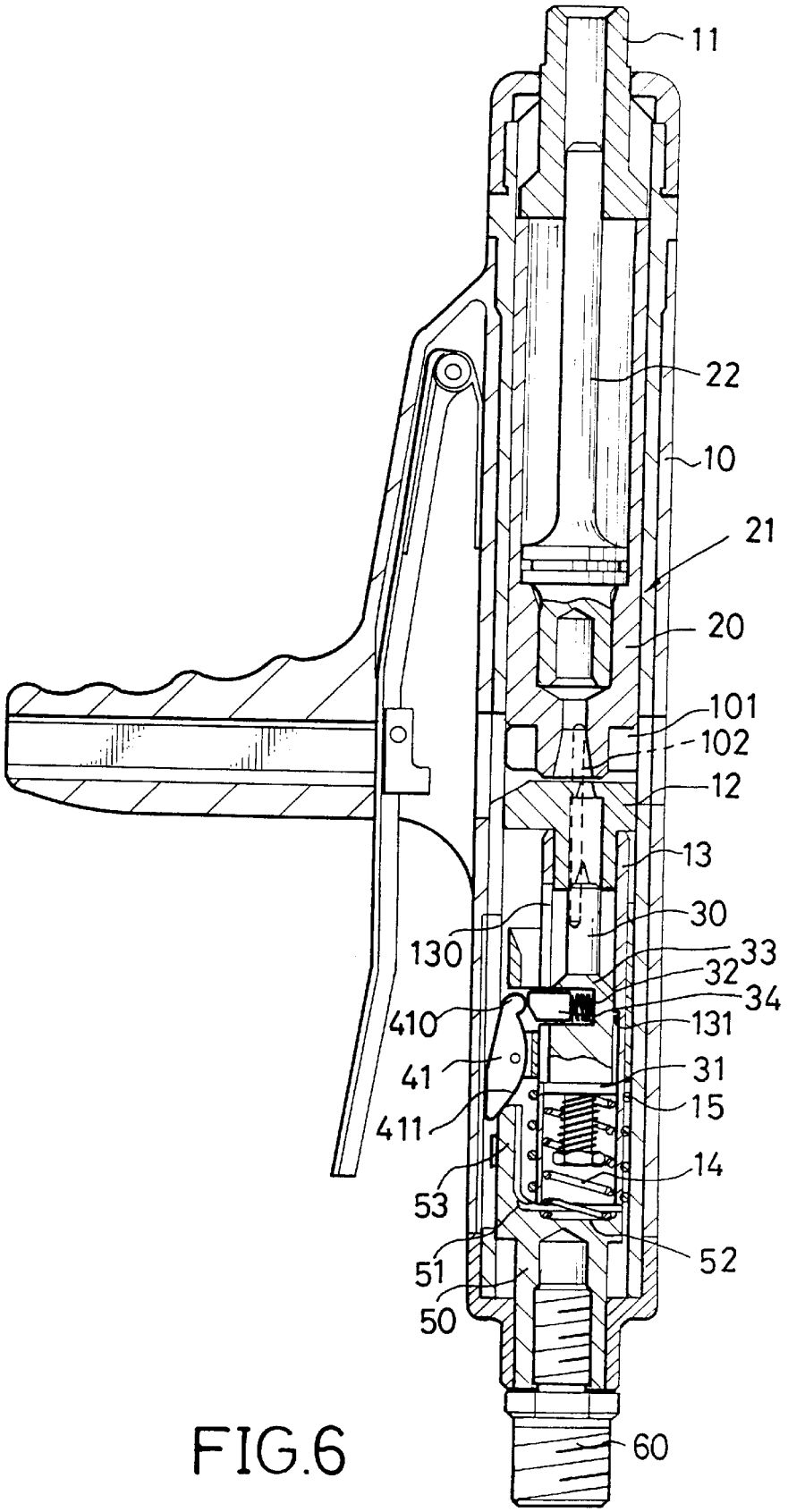
FIG. 6 is a partially cross-sectional view showing the tube assembly of the shaft-operated nailing tool being positioned in place within a barrel body with the trigger member being depressed.
Figure 7:
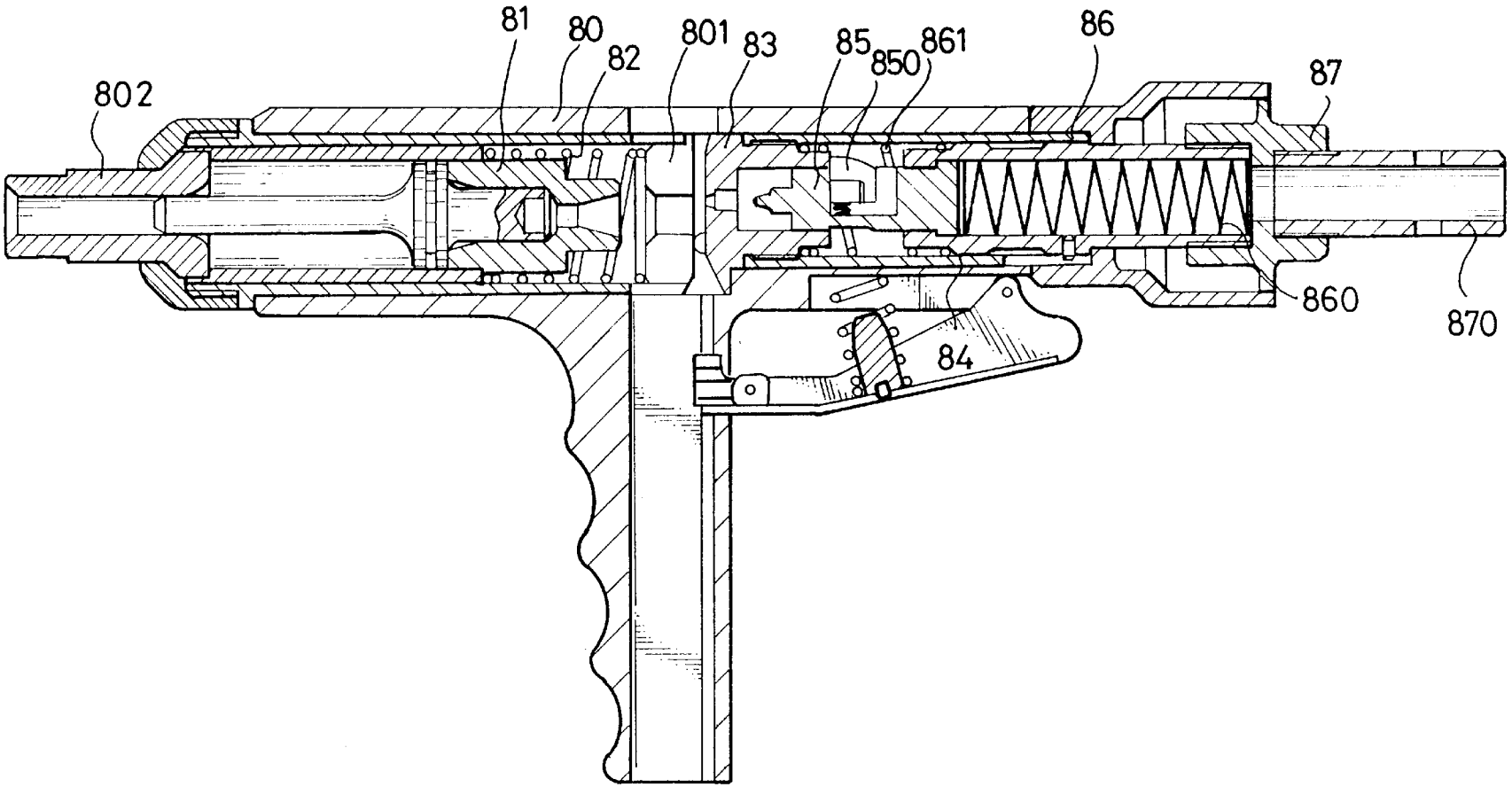
FIG.7 PRIOR ART
FIG. 7 is a schematic cross-sectional view of a conventional shaft-operated nailing tool.

Then the force exerted on the connector (60) will further compress the springs (40) and (50) by way of the stock (50), with the extension (53) of the stock (50) being brought into contact with the slanting edge (411) at the back end of the lever (41). At this time, the lever (41) is pivoted clockwise and the front end of the lever (41) is moved upward to press the trigger member (34) of the firing-pin (50) radially inward in relation with the cocking member (40), as shown in FIG. 6. Once the trigger member (34) is fully released from the U-shaped stop, the firing-pin (30) is pushed by the compressed inner spring (40) forwardly towards the annular stop (101) and strikes a bullet (not shown) in this stop (101).

It is to be noted that a significant benefit arising from the nailing tool of the present invention is the assurance of the tube assembly (20) to be positioned in place before the striking of the firing-pin (30). This may reliably prevent the operation of the nailing tool in error, which could be fatally harmful to the operator during the use of the tool.

What is claimed is:

1. In a shaft-operated nailing tool of the type having a barrel body with an annular stop secured therein, and a tube assemble movable forward from and backward to the annular stop within the barrel body, the improvement comprising:

a position member having a sleeve extending backwardly therefrom;

a firing-pin movably received in said sleeve of said position member;

a cocking member mounted around said sleeve of said position member, said cocking member having a lever pivotally connected thereto;

a stock movably disposed in a rear portion of said barrel body behind said firing-pin and said sleeve of said position member;

an inner spring compressed between said firing-pin and said stock;

an outer spring compressed between said cocking member and said stock;

a connector for interconnecting said stock and said shaft;

a linkage extending through said annular stop and said position member from said tube assemble to said cocking member; and said lever of said cocking member having a front end in relation with said firing-pin and a rear end in relation with said stock so that said front end of said lever may trigger said firing-pin when said stock is pushed forward sufficiently with respect to said barrel body.

2. The shaft-operated nailing tool as claimed in claim 1, wherein said cocking member includes:

a cylindrical body to mount said cocking member around said sleeve of said position member;

a U-shaped stop formed on said cylindrical body beneath the front end of said cylindrical body;

a tap depending from a rear end of said cylindrical body to be pivoted to said lever;

a protrusion formed in said cylindrical body so as to abut the end of said linkage; and said cylindrical body having an opening defined axially between said U-shaped stop and said tap, said opening corresponding to said front end of said lever.

3. The shaft-operated nailing tool as claimed in claim 2, wherein said lever of said position member is formed at said front end thereof with a cam corresponding to said opening of said positioning member and at said rear end thereof with a slanting edge corresponding to said stock, and wherein said stock is formed at a front end thereof with an extension which may contact with said slanting edge of said lever of said position member.

4. The shaft-operated nailing tool as claimed in claim 1, wherein said sleeve of said position member has a groove defined in place at the bottom thereof, said groove being in communication with said opening of said positioning member.

5. The shaft-operated nailing tool as claimed in claim 1, wherein said sleeve of said positioning member comprises a front section having a first inner diameter and a rear section having a second inner diameter larger than said first inner diameter with a step formed at an intersection between said first and second inner diameters, and wherein said firing-pin has a circular back plate which is pressed by said inner spring and which is sized to be stopped at said step of said sleeve when said firing-pin is moved forward beyond a predetermined position.

6. The shaft-operating nailing tool as claimed in claim 1, wherein said firing pin has a radial blind bore, a trigger member movably receive and a compression spring disposed between said trigger member and the bottom end of said blind bore.

7. The shaft-operated nailing tool as claimed in claim 1, wherein said stock has a threaded tubular portion formed at the rear end thereof for threadedly engaging with said connector.

8. The shaft-operated nailing tool as claimed in claim 1, wherein said stock has formed at a front end thereof with an outer recess in contact with said outer spring and an inner recess in contact with said inner spring.

* * * * *